US012146489B2

(12) United States Patent
Fagerli et al.

(10) Patent No.: US 12,146,489 B2
(45) Date of Patent: Nov. 19, 2024

(54) VALVE ASSEMBLY FOR AN ELECTRICAL REFRIGERANT COMPRESSOR

(71) Applicant: Brose Fahrzeugteile SE & Co. Kommanditgesellschaft, Würzburg, Würzburg (DE)

(72) Inventors: Björn Fagerli, Rosbach-Rodheim (DE); Budi Rinaldi, Frankfurt am Main (DE); Pierre Schmitt, Karlstadt (DE); Regina Kilian, Würzburg (DE)

(73) Assignee: Brose Fahrzeugteile SE & Co. Kommanditgesellschaft, Würzburg (DE)

( * ) Notice: Subject to any disclaimer, the term of this patent is extended or adjusted under 35 U.S.C. 154(b) by 775 days.

(21) Appl. No.: 17/270,811

(22) PCT Filed: Aug. 22, 2019

(86) PCT No.: PCT/EP2019/072455
§ 371 (c)(1),
(2) Date: Feb. 23, 2021

(87) PCT Pub. No.: WO2020/039024
PCT Pub. Date: Feb. 27, 2020

(65) Prior Publication Data

US 2021/0207600 A1 Jul. 8, 2021

(30) Foreign Application Priority Data

Aug. 24, 2018 (DE) ..... 10 2018 214 369.2

(51) Int. Cl.
*F04C 14/24* (2006.01)
*F04C 2/02* (2006.01)

(52) U.S. Cl.
CPC ..... *F04C 14/24* (2013.01); *F04C 2/025* (2013.01); *F04C 2240/40* (2013.01); *F04C 2270/185* (2013.01)

(58) Field of Classification Search
CPC .. F04C 2/02; F04C 2/025; F04C 14/24; F04C 15/068; F04C 28/10; F04C 28/16;
(Continued)

(56) References Cited

U.S. PATENT DOCUMENTS 2,302,447 A 11/1942 King et al.
3,939,867 A * 2/1976 Lundvik ..... F16K 15/1402 137/856
(Continued)

FOREIGN PATENT DOCUMENTS

CN 2874103 Y 2/2007
CN 101092962 A 12/2007
(Continued)

OTHER PUBLICATIONS

DE-102011082936-A1, English Translation of De-102011082936-A1 (Year: 2013).*
(Continued)

*Primary Examiner* — Dominick L Plakkoottam
*Assistant Examiner* — Charles W Nichols
(74) *Attorney, Agent, or Firm* — Dickinson Wright PLLC

(57) ABSTRACT

A valve assembly for an electrical refrigerant compressor of a motor vehicle, comprising: a flexurally elastic valve plate for the pressure-regulated opening and closing of an outlet opening of the refrigerant compressor; and a rigid stop plate for limiting the movement of the valve plate, the stop plate and the valve plate being in the form of a preassembled component.

18 Claims, 10 Drawing Sheets

(58) Field of Classification Search
CPC .. F04C 28/24; F04C 2240/40; F04C 2270/18; F04C 2270/185; F16K 7/12–20; F16K 15/16; F16K 15/144; F16K 15/1402; F16B 21/071; Y10T 137/7891; Y10T 137/7892; Y10T 137/7888; Y10T 137/7887
USPC ..... 137/852, 855, 856, 857, 858
See application file for complete search history.

(56) References Cited

U.S. PATENT DOCUMENTS

| | | | | |
|---|---|---|---|---|
| 4,373,822 | A | 2/1983 | Tkac | |
| 6,186,514 | B1 | 2/2001 | Ikeda et al. | |
| 9,039,318 | B2 * | 5/2015 | Mantei | F16B 21/09 403/361 |
| 9,050,690 | B2 * | 6/2015 | Hammer | F16B 5/0642 |
| 9,216,704 | B2 * | 12/2015 | Morris | B60R 16/0215 |
| 9,447,806 | B2 * | 9/2016 | Morris | F16B 5/0628 |
| 2004/0191083 | A1 * | 9/2004 | Gennami | F04C 23/008 417/310 |
| 2013/0185916 | A1 * | 7/2013 | Mantei | F16B 5/0664 403/361 |
| 2015/0165609 | A1 * | 6/2015 | Morris | F16B 5/0628 269/52 |
| 2015/0165986 | A1 * | 6/2015 | Morris | B60R 21/20 248/505 |
| 2017/0321693 | A1 | 11/2017 | Geither et al. | |

FOREIGN PATENT DOCUMENTS

| | | | | |
|---|---|---|---|---|
| CN | 104708309 | A | 6/2015 | |
| CN | 204805642 | U | 11/2015 | |
| CN | 107605708 | A | 1/2018 | |
| DE | 2235566 | A1 | 2/1973 | |
| DE | 2221541 | A1 | 11/1973 | |
| DE | 102010038790 | A1 | 2/2012 | |
| DE | 102011082936 | A1 * | 3/2013 | B60R 13/0838 |
| DE | 102016206511 | A1 | 6/2017 | |
| JP | 2006183458 | A | 7/2006 | |
| JP | 2007327376 | A | 12/2007 | |
| WO | 2007037239 | A1 | 4/2007 | |

OTHER PUBLICATIONS

Chinese Office Action for Application No. 201980054246.8, dated Mar. 22, 2023, English Translation attached to original, All together 13 Pages.

* cited by examiner

VALVE ASSEMBLY FOR AN ELECTRICAL REFRIGERANT COMPRESSOR

CROSS-REFERENCE TO RELATED APPLICATIONS

This application is the U.S. National Phase of PCT Application No. PCT/EP2019/072455 filed on Aug. 22, 2019, which claims priority to German Patent Application No. DE 10 2018 214 369.2, filed on Aug. 24, 2018, the disclosures of which are hereby incorporated in their entirety by reference herein.

TECHNICAL FIELD

The present disclosure relates to a valve assembly for an electrical refrigerant compressor of a motor vehicle.

BACKGROUND

Motor vehicles are generally fitted with air conditioning systems which air-condition the vehicle interior by means of a system forming a refrigerant circuit. Such systems in principle have a circuit in which a refrigerant is guided. The refrigerant, for example R-134a (1,1,1,2-tetrafluoroethane) or R-744 (carbon dioxide), is heated at an evaporator and compressed by means of a (refrigerant) compressor, and the refrigerant subsequently releases the absorbed heat again via a heat exchanger before being guided to the evaporator again via a throttle valve.

SUMMARY

One or more objects of the present disclosure is to provide a particularly suitable valve assembly for an electrical refrigerant compressor of a motor vehicle and a refrigerant compressor for a motor vehicle, having such a valve assembly.

The valve assembly according to one or more embodiments may be suitable and adapted for an electrical refrigerant compressor of a motor vehicle. The valve assembly is in the form of a non-return valve, such as in the form of a pressure-controlled or pressure-regulated flutter valve.

To that end, the valve assembly has a flexurally elastic or spring-elastic valve plate as the valve flap (spring flap, flutter flap) for the pressure-regulated opening and closing of an exit opening of the refrigerant compressor. In addition, a rigid or stiff stop plate is provided, which stop plate limits the movement of the valve plate in along a passage or open position in which the exit opening is open. In other words, the adjustment travel of the valve plate is limited by means of the stop plate. Owing to the restoring forces that arise as a result of the flexural elasticity, the valve flap is moved at low pressure into a closed position in which the valve plate closes or covers the exit opening.

According to one or more embodiments, it is provided that the stop plate and the valve plate are in the form of a common, preassembled component. In other words, a preassembled valve assembly is used for assembling the refrigerant compressor. This means that the valve assembly is mounted on the refrigerant compressor as a preliminary assembly or delivery assembly. This permits an improved degree of prefabrication, so that the production and assembly costs of the refrigerant compressor are consequently reduced. As an example, it is thus possible to produce the valve assembly formed by the stop plate and the valve plate separately from the refrigerant compressor. As a result, a suitable valve assembly is provided.

In contrast to the prior art, the stop plate and the valve plate are thus not attached to the refrigerant compressor individually. Instead, the preassembled component, or the valve assembly, is fixed or installed directly on the refrigerant compressor.

In the prefabricated or preassembled state, the stop plate acts as a protective element for the valve plate, so that the valve assembly can be transported and handled simply and with a reduced outlay. Furthermore, a simple and time-saving pre-testing of the valve assembly in the course of the preassembly is possible, whereby the production and/or assembly costs of the refrigerant compressor are reduced further.

The valve plate has a smaller or reduced thickness compared to the stop plate. The valve plate is produced, for example, from a sheet material, such as from a spring steel material or plastics material. The stop plate is produced, for example, from the same material as the valve plate but, owing to its greater thickness, has reduced flexural elasticity and thus increased mechanical stiffness or strength.

In one or more embodiments, the valve plate is fastened to the stop plate by positive-locking and/or frictional engagement. In other words, the valve plate and the stop plate of the valve assembly are joined together or to one another by positive-locking and/or frictional engagement. As a result, no additional or separate fastening means are necessary during the (pre)assembly of the valve assembly, so that a simple and low-outlay as well as cost-reduced production and assembly of the valve assembly is ensured. Furthermore, as a result of the positive-locking and/or frictional fastening of the valve plate to the stop plate, the valve plate is fastened to the stop plate so that it does not become lost.

Here and in the following, "positive-locking engagement" or a "positive-locking connection" between at least two mutually connected parts is understood as meaning for example that the mutually connected parts are held together at least in one direction by direct interengagement of contours of the parts themselves or by indirect interengagement via an additional connecting part. The "blocking" of a mutual movement in that direction thus takes place as a result of shape.

Here and in the following, "frictional engagement" or a "frictional connection" between at least two mutually connected parts is understood as meaning for example that the mutually connected parts are prevented from sliding against one another by a frictional force acting between them. In the absence of a "connecting force" (i.e. the force that presses the parts against one another, for example a screw force or weight force itself) that causes this frictional force, the frictional connection cannot be maintained and may thus be released.

In another embodiment, the stop plate has at least one axially protruding centering projection which is integrally, that is to say in one piece or monolithically, formed thereon and which passes through a recess of the valve plate. In other words, the valve plate has at least one recess in which the centering projection of the stop plate engages or is seated. During the preassembly of the valve assembly, the at least one centering projection acts as a centering and/or alignment aid when joining together the valve plate and the stop plate.

"Protrude axially" is to be understood as meaning for example that the centering projection projects from the stop plate based on the assembled state on the refrigerant compressor—in an axial direction. The centering projection is thus oriented substantially transversely or perpendicularly to the plane of the stop plate and/or the plane of the valve plate.

The centering projection is formed on the stop plate, for example, as a local deformation or embossment.

In a suitable further development, the at least one centering projection of the stop plate is in the form of an approximately dome-shaped, that is to say approximately hemispherical, centering dome, or in the form of an approximately bolt-shaped, that is to say approximately cylindrical, centering bolt or centering pin. As a result, a particularly suitable centering projection of the valve assembly is provided.

In one or more embodiments, the valve plate has in the region of the recess a flexurally elastic clamping lug which, in the preassembled state, effects positive-locking and/or frictional engagement with the centering projection of the stop plate. The clamping lug is formed in one piece, that is to say integrally or monolithically, in the region of the recess, such as the clamping lug is isolated by the recess. The clamping lug thus projects into the recess from the edge of the recess.

During the preassembly of the valve assembly, the centering projection of the stop plate is inserted into the recess of the valve plate, and the clamping lug lies at its free end against the centering projection. On insertion of the centering projection, the clamping lug is bent at least partly, so that the centering projection, owing to the restoring forces, is held clamped between the clamping lug and the edge of the recess. The centering projection is thus clamped in the recess in a radial direction, that is to say transversely to the axial or longitudinal direction of the centering projection. As an example, the free end of the clamping lug thereby grips the centering projection at least in some regions. As a result of the clamping lug gripping the centering projection, positive-locking and frictional engagement between the stop plate and the valve plate that is particularly secure in operation and reliable is achieved.

Alternatively, it is, for example, also conceivable that the stop plate and the valve plate are fastened to one another by form-fitting and/or frictional engagement by means of a different mounting and connecting method, such as by means of a deformation method, such as, for example, press-fitting or clinching.

In another embodiment, the stop plate has a fastening portion, which is fastened or is able to be fastened to the refrigerant compressor, and at least one stop finger extending in an inclined manner relative thereto, and the valve plate has, complementary thereto, a fastening portion fastened to the fastening portion of the stop plate and at least one flexurally elastic valve finger.

The electrical refrigerant compressor according to the invention is suitable and adapted for a motor vehicle. The refrigerant compressor has an electromotive drive and a compressor coupled therewith for conveying a refrigerant. The compressor has an inlet or an entry opening and an outlet or an exit opening.

The refrigerant compressor is suitable and adapted such as for compressing a refrigerant of an air conditioning system of a motor vehicle. In another installation situation, the refrigerant compressor is arranged for that purpose in a refrigerant circuit of the air conditioning system. The refrigerant enters the refrigerant compressor via an inlet opening on the low pressure side, is compressed inside the refrigerant compressor and exits into the refrigerant circuit via an outlet opening on the high pressure side. The outlet opening can thereby be closed by the refrigerant pressure in a pressure-regulated or pressure-controlled manner by means of the valve assembly described hereinbefore.

By the use of a preassembled valve assembly, a simple and inexpensive assembly of the refrigerant compressor is ensured. As a result, a suitable refrigerant compressor is provided.

In one or more embodiments, the compressor is in the form of a scroll compressor. The compressor may include a scroll part (scroll spiral, fixed scroll) that is fixed or seated in a stationary manner in a compressor housing and a movable scroll part (scroll spiral) that is driven eccentrically by the electromotive drive.

The movable scroll part thereby forms the movable or driven compressor part. The scroll parts each have a plate- or disk-like base body on which a helical spiral body is formed in an axially protruding manner. The pair of scrolls thereby formed is arranged in the assembled state in an interleaved manner, which means that the spiral body of the movable scroll part engages at least in part into the spiral intermediate space of the fixed scroll part. The outlet opening is thereby expediently introduced centrally into the fixed scroll part.

BRIEF DESCRIPTION OF THE DRAWINGS

Exemplary embodiments of the invention will be explained in greater detail hereinbelow with reference to a drawing, in which.

Mutually corresponding parts and sizes are always provided with the same reference signs in all the figures.

DETAILED DESCRIPTION

Figure 1:
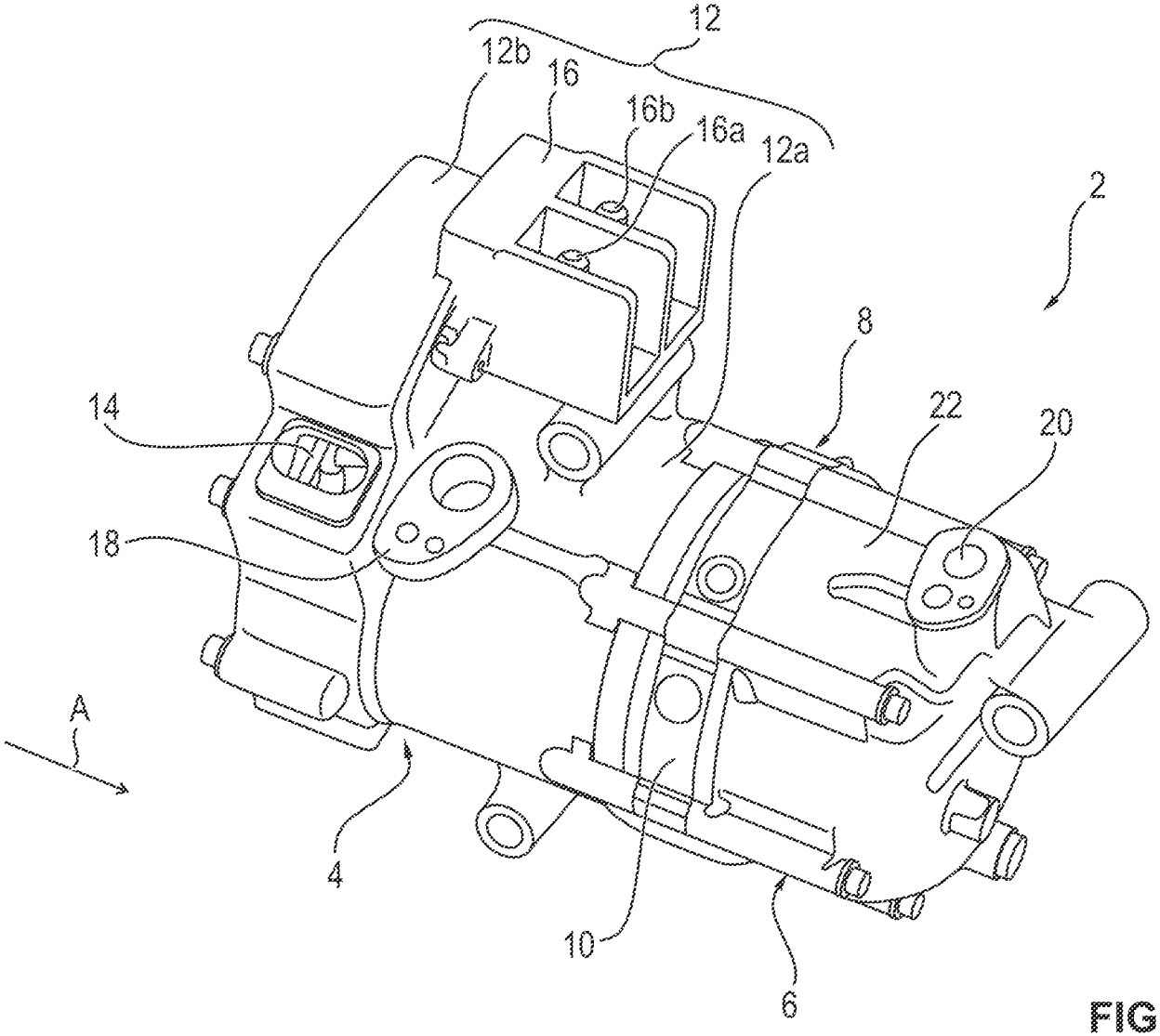
FIG. 1 shows, in a perspective side view, an electromotive refrigerant compressor having an electromotive drive and having a compressor.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Motor vehicles may include scroll machines, for example, that are in principle possible as compressors for the refrigerant. Such a refrigerant compressor is described, for example, in DE 10 2016 206 511 A1.

Scroll compressors typically have two scroll parts which are movable relative to one another and which work in the manner of a displacement pump during operation. The two scroll parts are typically in the form of a pair of interleaving (helical) spirals or scrolls. In other words, one of the spirals engages at least in part into the other spiral. The first (scroll) spiral is fixed relative to a compressor housing (stationary scroll, fixed scroll), and the second (scroll) spiral (movable scroll) is driven in an orbiting manner inside the first spiral by means of the electric motor.

An orbiting movement is to be understood as being such as an eccentric, circular movement path, in which the second spiral does not itself rotate about its own axis. As a result, the scroll parts are always at a minimum distance from one another, and two substantially crescent-shaped (refrigerant) chambers are formed between the spirals on each orbiting movement, the volume of which chambers is increasingly reduced (compressed) in the course of the movement. The refrigerant to be pumped is thereby drawn in from outside, compressed inside the scroll parts and discharged via a central outlet opening in the center of the fixed scroll part (spiral center).

For the pressure-regulated discharge of the refrigerant from the outlet opening there are used, for example, so-called flutter valves in the form of valve assemblies.

A flutter valve is hereby to be understood as being such as a non-return valve which opens in the passage direction without any other external drive, merely as a result of pressure differences on the two sides of the valve, and closes again, that is to say covers the outlet opening, automatically.

The valve assembly thereby has, for example, a comparatively thin metal plate as a flexurally elastic or spring-elastic valve plate, the flexural elasticity of which metal plate at the same time ensures that the valve closes reliably. The valve assembly further has, for example, a comparatively thick metal plate as a rigid or stiff stop plate, which, as a stop, limits the movement of the valve plate in the passage opening and thus ensures functioning of the valve in the case of a pressure difference contrary to the opening direction.

Generally, the valve plate and the stop plate are mounted as individual components on the fixed scroll of the refrigerant compressor by means of a fastening screw.

The refrigerant compressor 2 shown in FIG. 1 may be installed in a refrigerant circuit, not shown in greater detail, of an air conditioning system of a motor vehicle. The electrical refrigerant compressor 2 has an electromotive (electric) drive 4 and a compressor (compressor head) 6 coupled therewith. A transition region formed between the drive 4 and the compressor 6 has a mechanical interface 8 with an end shield 10 on the drive side. The compressor 6 is connected in terms of drive engineering to the drive 4 via the mechanical interface 8.

The drive 4 shown in FIG. 1 comprises a cup-like drive housing 12 having two housing portions 12*a* and 12*b* which are separated from one another in a fluid-tight manner by a monolithically integrated housing intermediate wall inside the drive housing 12.

The housing portion on the compressor side is in the form of a motor housing 12*a* for accommodating an electric motor, not shown in greater detail, and is closed on one side by the (housing) intermediate wall and on the other side by the end shield 10. The housing portion on the opposite side of the intermediate wall is in the form of an electronics housing 12*b* in which there is accommodated a motor electronics system 14 which controls the electric motor.

The drive housing 12 has in the region of the electronics housing 12*b* a housing terminal portion 16 for electrically contacting the electronics system 14 with an electrical system of the motor vehicle. The housing terminal portion 16 comprises two terminals 16*a* and 16*b* which are guided to the electronics system 14 and are electrically contacted therewith inside the electronics housing 12*b*.

The drive housing 12 has, approximately at the level of the housing terminal portion 16, a (refrigerant) inlet 18 for connection to the refrigerant circuit. Via the inlet 18, which will also be referred to hereinbelow as the inlet opening, a refrigerant of the refrigerant circuit flows into the drive housing 12, such as into the motor housing 12*a*. From the motor housing 12*a*, the refrigerant flows through the end shield 10 to the compressor 6. The refrigerant is then compressed by means of the compressor 6 and exits at a bottom (refrigerant) outlet or outlet opening 20 of the compressor 6 into the refrigerant circuit of the air conditioning system.

The outlet 20 is formed at the bottom of a cup-shaped compressor housing 22 of the compressor 6. In the connected state, the inlet 18 forms the low pressure or suction side and the outlet 20 forms the high pressure or pump side of the refrigerant compressor 2.

Figure 2:
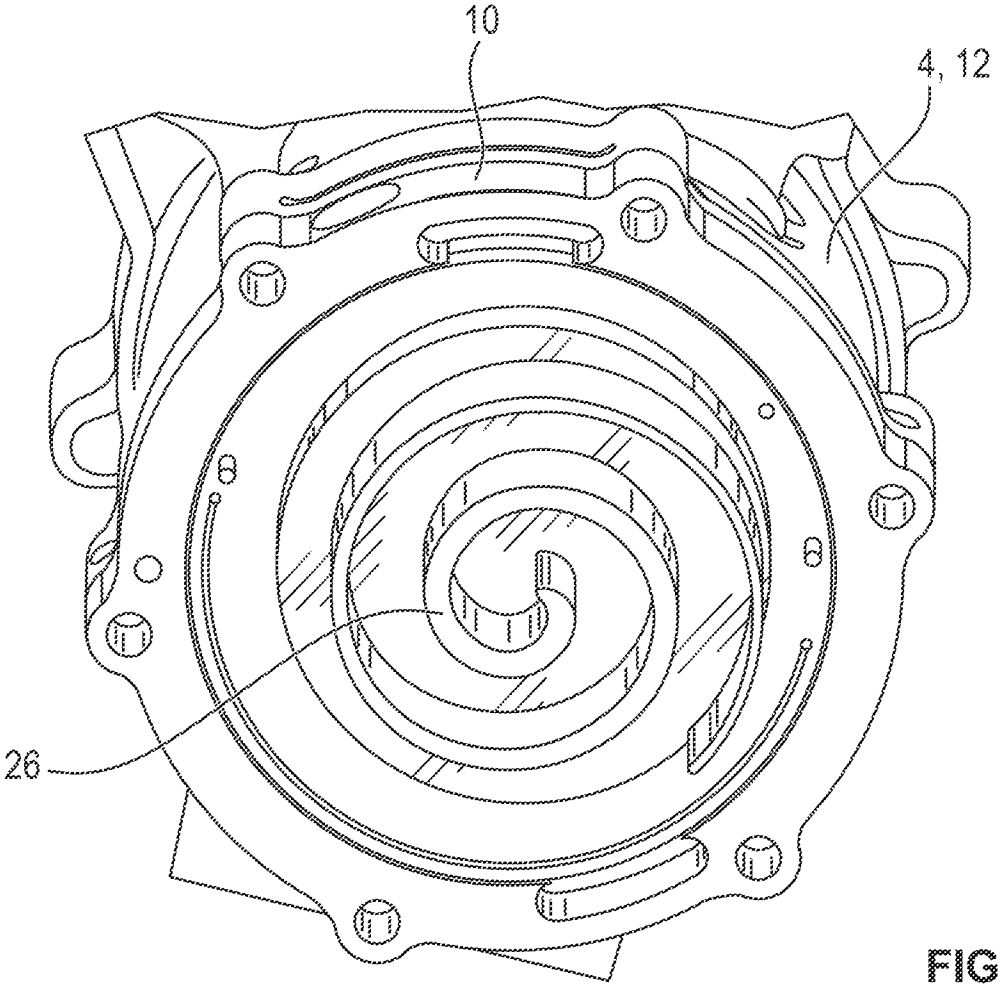
FIG. 2 shows, in a perspective representation, a detail of a fixed scroll part of the compressor.
Figure 3:
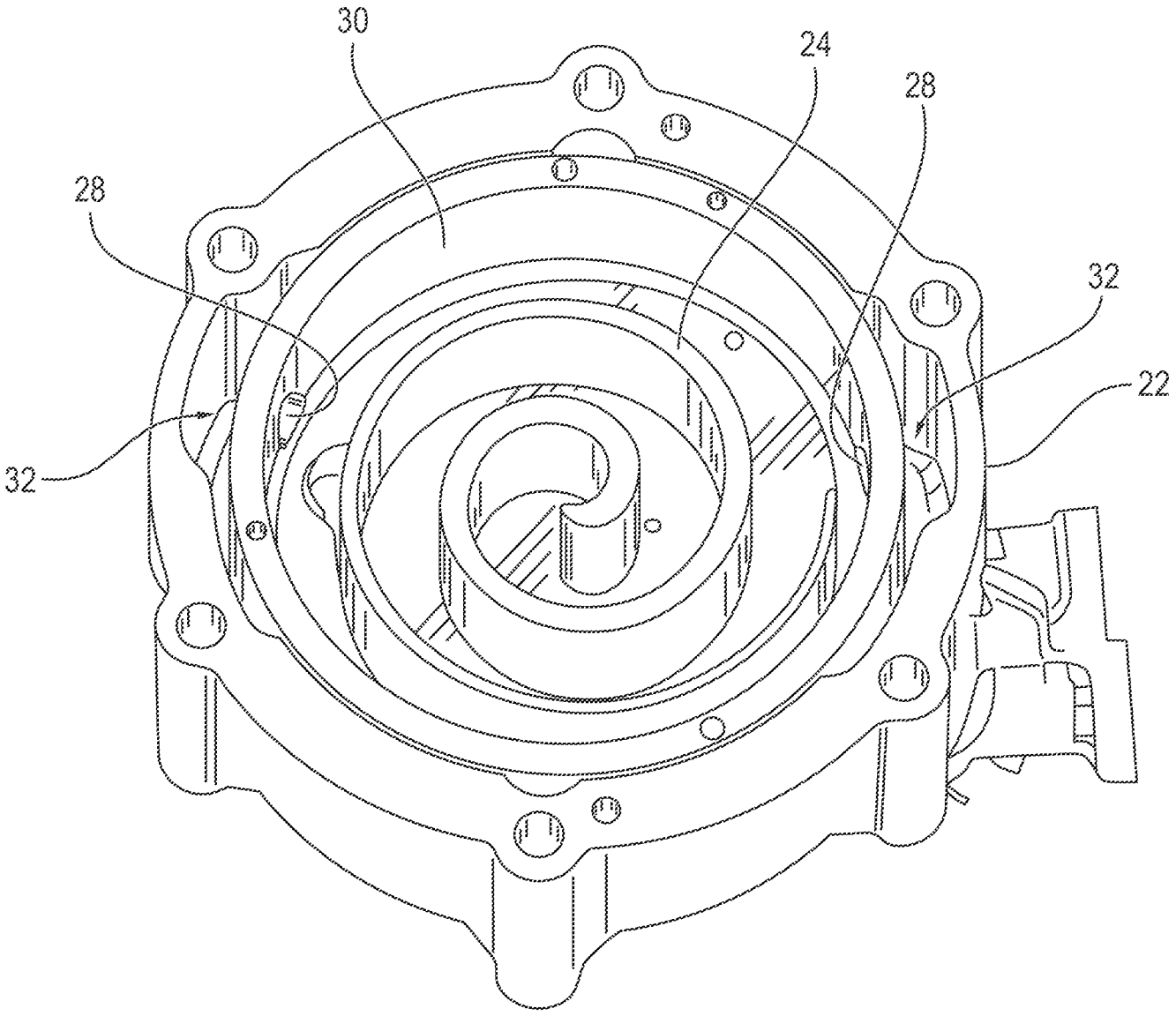
FIG. 3 shows, in a perspective representation, a detail of a movable scroll part of the compressor.

The compressor 6 described in greater detail with reference to FIGS. 2 to 5 has a pair of interleaving (helical) spirals or scrolls. The pair of scrolls comprises a compressor or scroll part 24 that is fixed (stationary) with respect to the compressor housing 22 (FIG. 3) and a compressor or scroll part 26 that is movable relative thereto (FIG. 2). The scroll or compressor parts 24 and 26 each have a scroll disk on which a spiral body is formed so as to protrude in an axial direction A. In the assembled state of the compressor 6, the spiral body of the movable scroll part 26 engages into the gaps or intermediate spaces of the spiral body of the fixed scroll part 24.

The scroll part 26 is moved in an orbiting manner along a circular path by means of an eccentrically arranged journal of a motor shaft, not shown in greater detail, and is thus driven by the drive 4 when the compressor is operating. The spiral bodies or scroll spirals of the scroll parts 24, 26 thereby maintain a minimum distance from one another, whereby, on each orbiting revolution, two increasingly smaller (refrigerant) chambers are formed between the spiral bodies for conveying and compressing the refrigerant. The refrigerant to be compressed is thereby drawn in via two inlet openings 28 of a side wall 30 of the scroll part 24 from in each case an associated intermediate region or recess 32 formed between the side wall 30 and the compressor housing 22, is compressed inside the compressor 6 and via a bottom (refrigerant) outlet opening 34 (FIG. 5) in the center of the spiral of the scroll part 24.

FIG. 2 shows the refrigerant compressor 2 with the compressor housing 22 removed, looking at the spiral body of the movable scroll part (movable scroll) 26.

Figure 4:
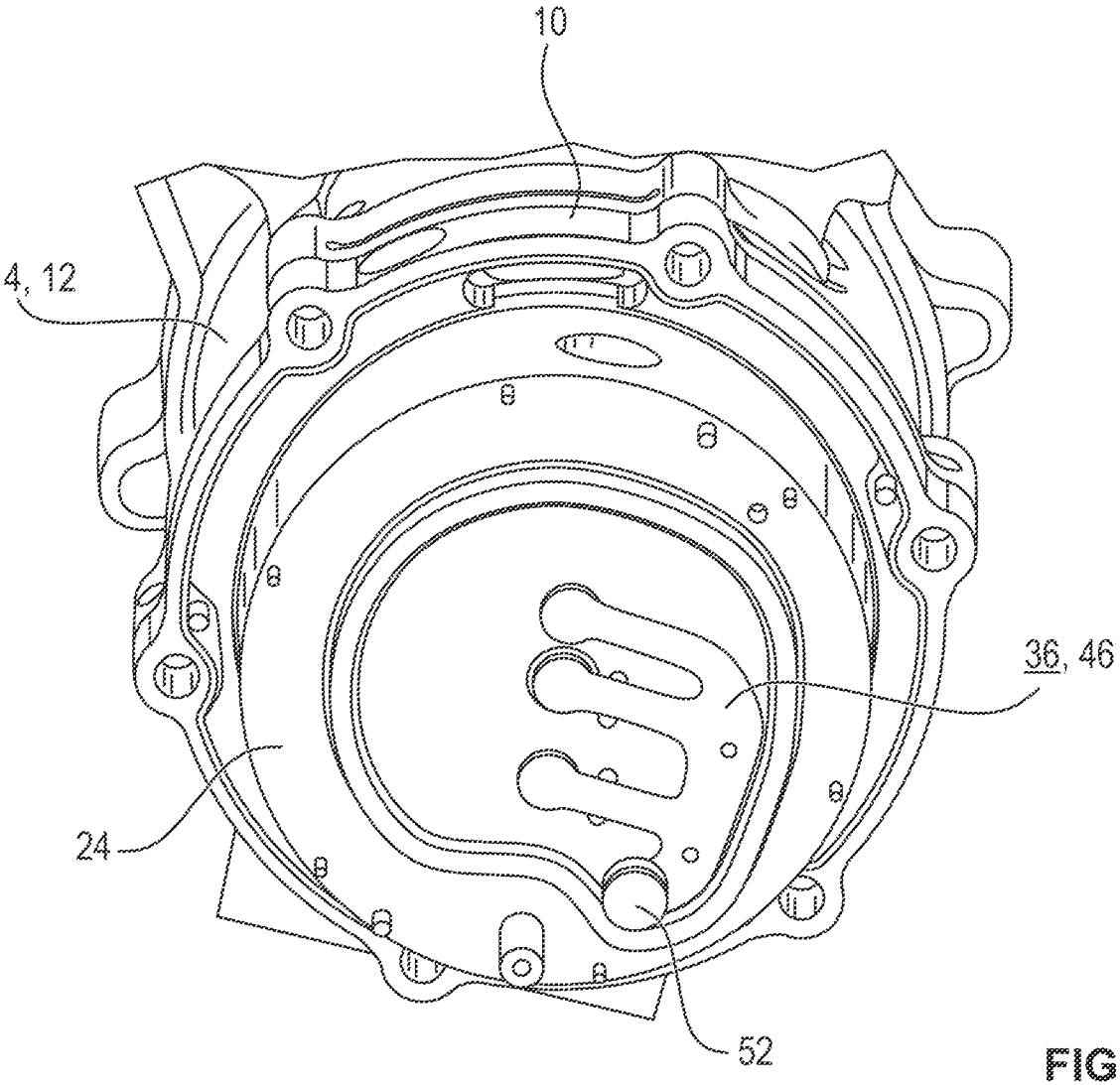
FIG. 4 shows, in a perspective representation, the lower side of the compressor with a compressor housing removed, looking at a valve assembly.
Figure 5:
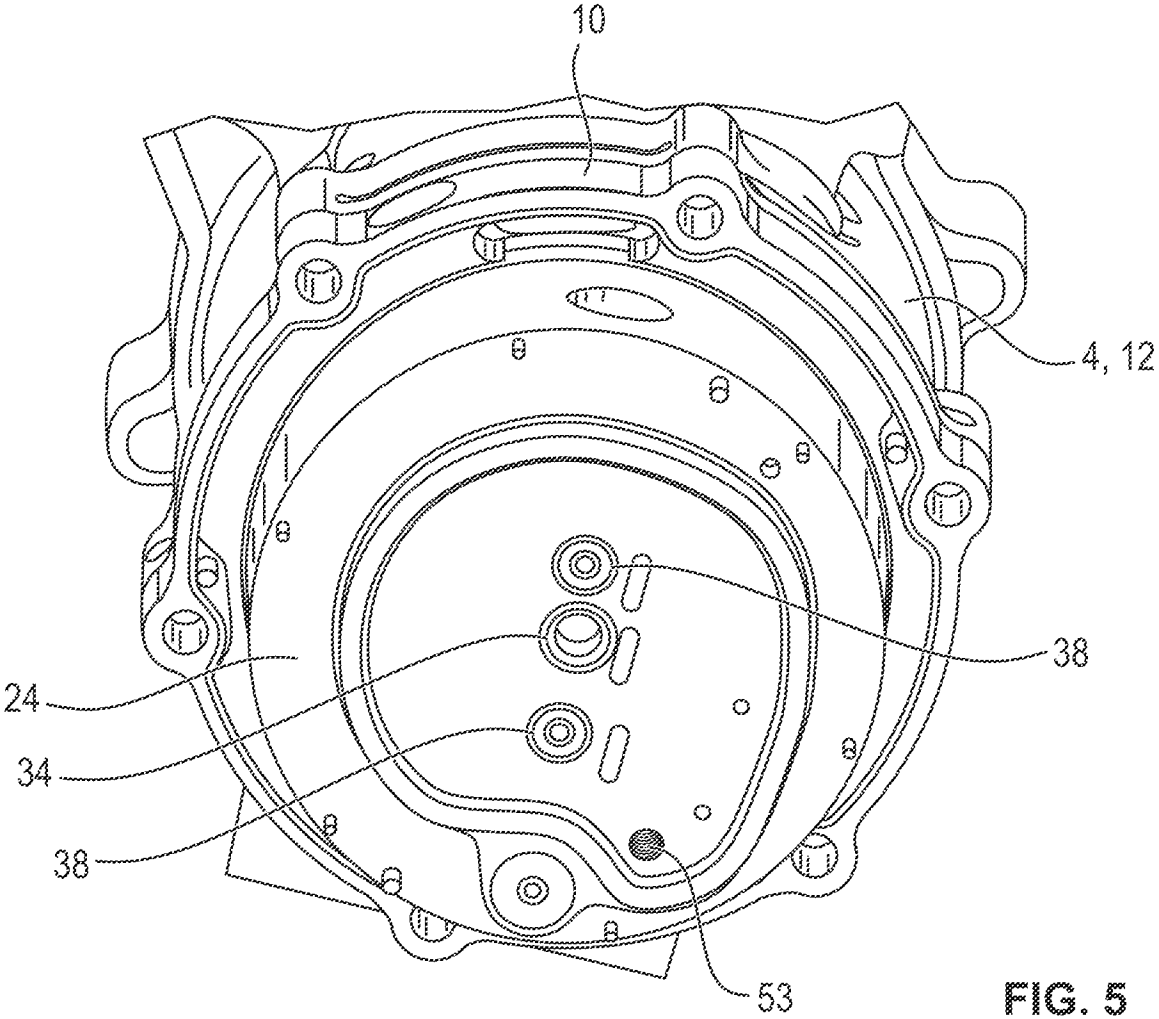
FIG. 5 shows, in a perspective representation, the lower side of the compressor module according to FIG. 4 without the valve assembly.

FIG. 4 and FIG. 5 show a detail of the compressor 6 of the electromotive refrigerant compressor 2 with a compressor housing 22 removed. The fixed scroll part 24 has on the base side a multi-limbed or multi-fingered valve assembly 36 as a covering or closing part, with which the central outlet opening 34, on the high pressure side, of the scroll part 24 is covered. Radially spaced apart from the outlet opening 34 there are provided two further outlet openings 38 as so-called pre-outlets or auxiliary outlets. The valve assembly 36 is provided on the one hand as the main valve for the outlet opening 34 and on the other hand as a pre-outlet or auxiliary outlet valve for the outlet openings 38 of the scroll part 24, with which over-compression of the refrigerant 2 is avoided during operation of the compressor.

The valve assembly 36 described hereinbelow with reference to FIGS. 6 to 11 is in the form of a non-return valve, such as in the form of a pressure-controlled or pressure-regulated flutter valve.

The valve assembly 36 has a flexurally elastic or spring-elastic valve plate 40. The valve plate 40 has an elongate fastening portion 42 on which there are integrally formed three valve fingers 44 as the pressure-regulated valve flap (spring flap, flutter flap) for opening and closing the respective associated outlet opening 24, 28 of the refrigerant compressor 2. The valve plate 40 is produced, for example, from a sheet material, such as from a spring steel material or plastics material. Owing to the restoring forces which arise as a result of the flexural elasticity, the valve fingers 44 of the valve flap 40 are moved into a closed position at low (refrigerant) pressure, in which the outlet openings 34, 38 are closed or covered by the respective associated valve finger 44. If the pressure is increased, then the pressure acting on the valve fingers 44 exceeds the restoring force, and the respective valve finger 44 is bent in an axial passage or opening direction, so that refrigerant is able to flow out of the associated outlet opening 34, 38.

The valve assembly 36 further has a rigid or stiff stop plate 46, which in the assembled state is arranged above the valve plate 40 so as to cover it. In the installed situation shown in FIG. 4, the stop plate 46 is fastened rigidly, that is to say substantially immovably, to the scroll part 24. The stop plate 46 is in the form of a stop for limiting the movement of the valve fingers 44 of the valve plate 40 in the passage or opening direction. In other words, the adjustment travel of the valve fingers 44 is limited by means of the stop plate 46.

The stop plate 46 has a cross-sectional shape which is complementary to that of the valve plate 40. The stop plate 46 has a fastening portion 48 and also three stop fingers 50 integrally formed thereon. In the assembled state, the fastening portion 48 is arranged in alignment with the fastening portion 42, and the stop fingers 50 are arranged in alignment with the valve fingers 44.

Figure 6:
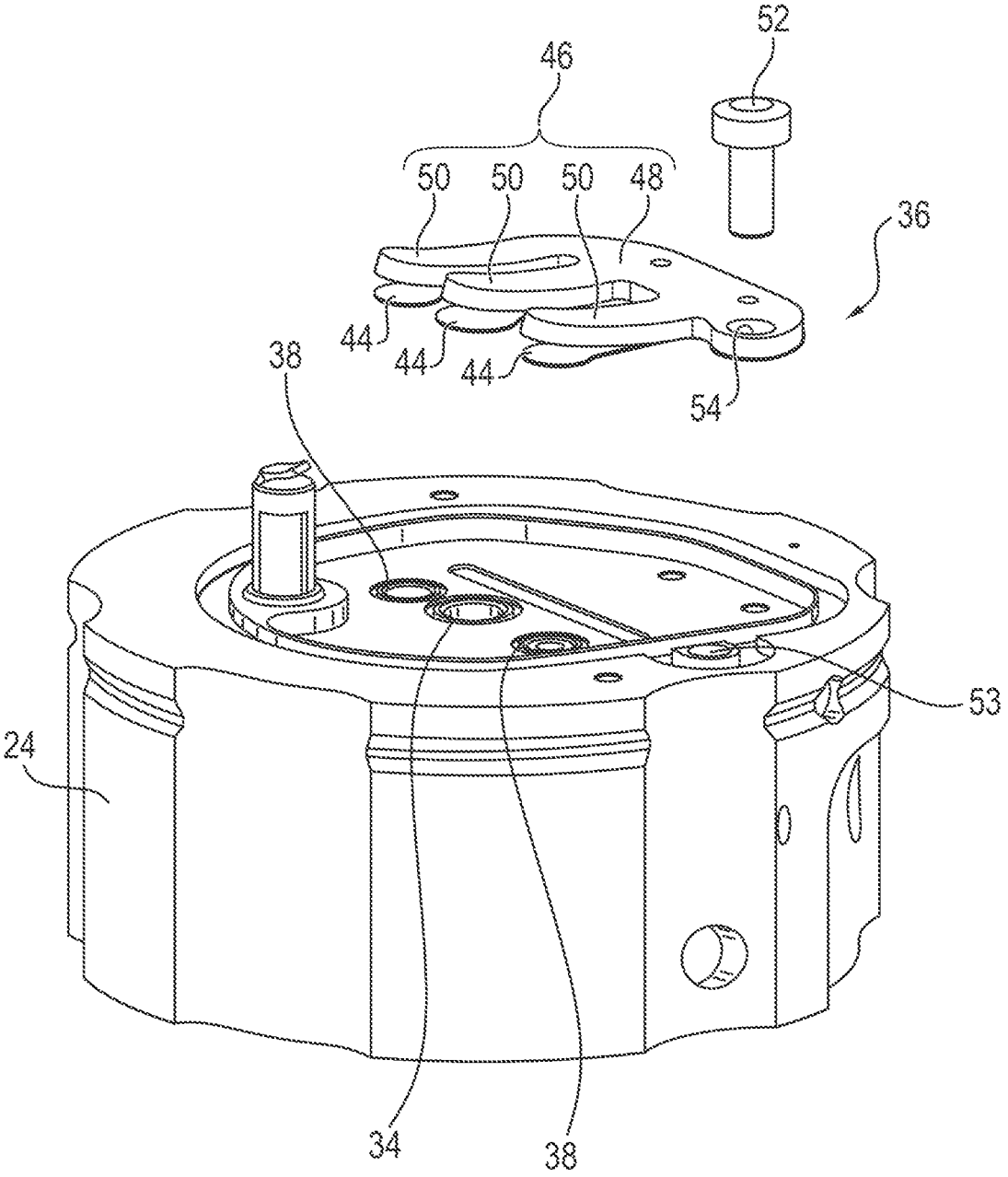
FIG. 6 shows, in a perspective exploded representation, the fixed scroll part and the valve assembly and also a fastening screw.
Figure 7:
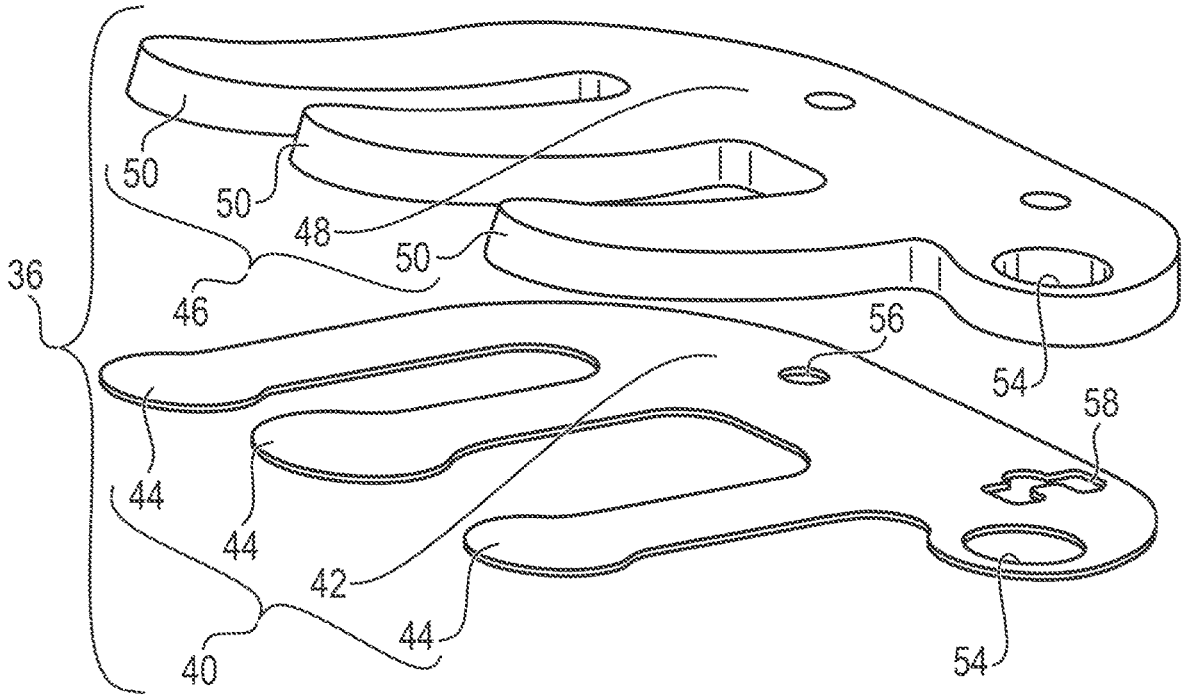
FIG. 7 shows, in a perspective exploded representation, the valve assembly with a stop plate and with a valve plate.

As is apparent, for example, in FIG. 6, the stop fingers 50 extend in an inclined manner or obliquely relative to the fastening portion 48. In other words, the stop fingers 50 are inclined with respect to the valve fingers 44, so that an adjustment travel for the respective valve fingers 44 is established at the free ends.

Figure 8:
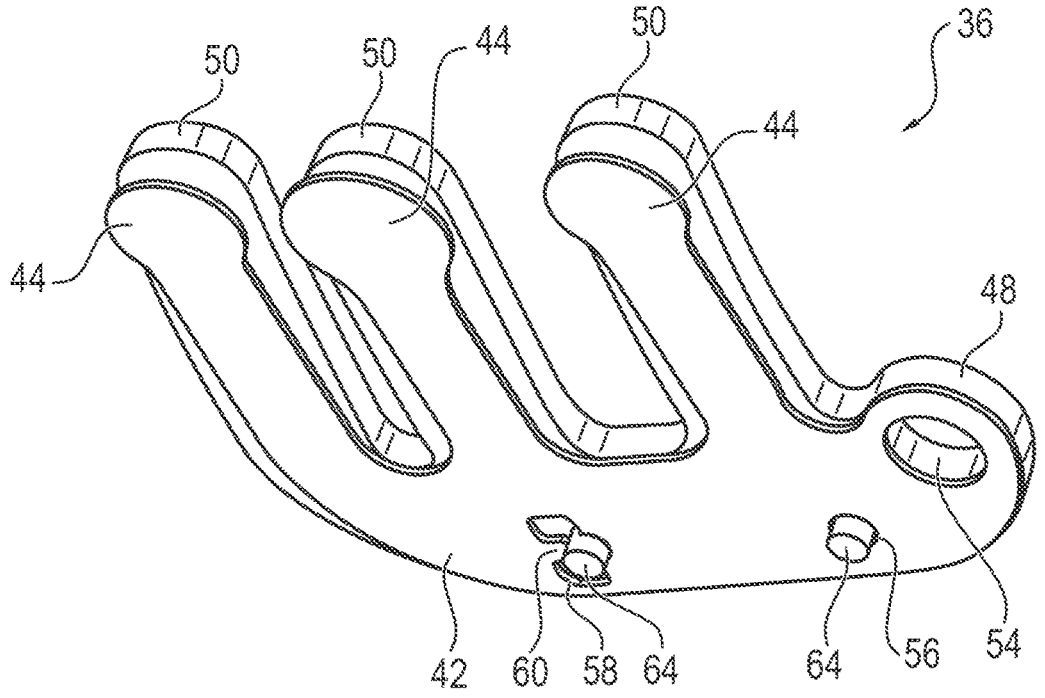
FIG. 8, FIG. 9 show, in a perspective representation, the valve assembly, looking at a side facing the scroll part, in different perspectives.
Figure 9:
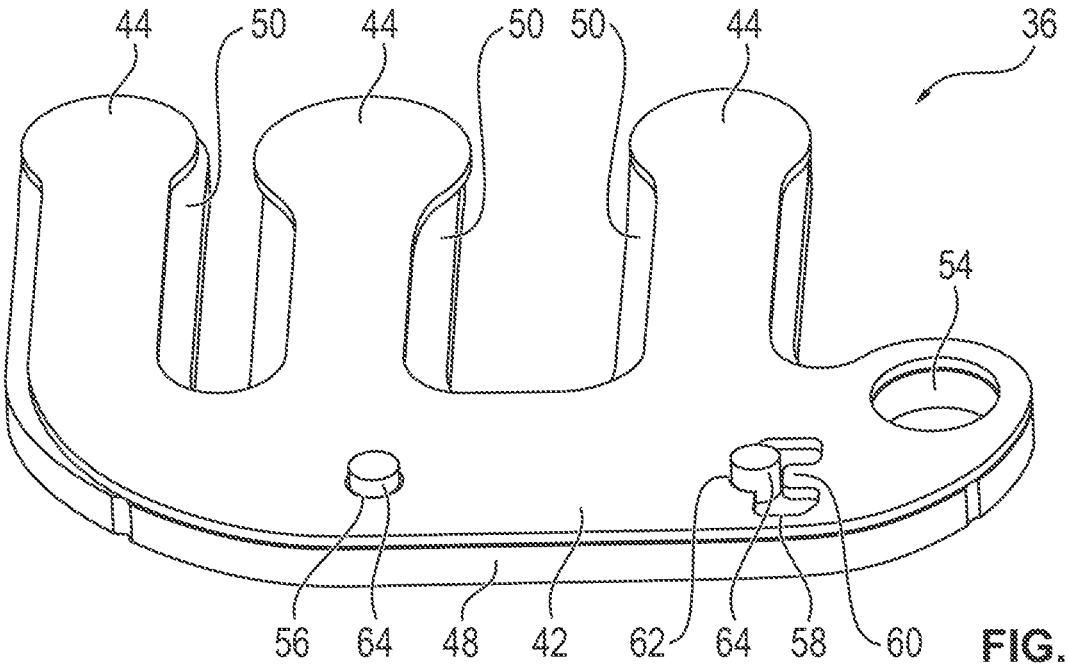
Figure 10:
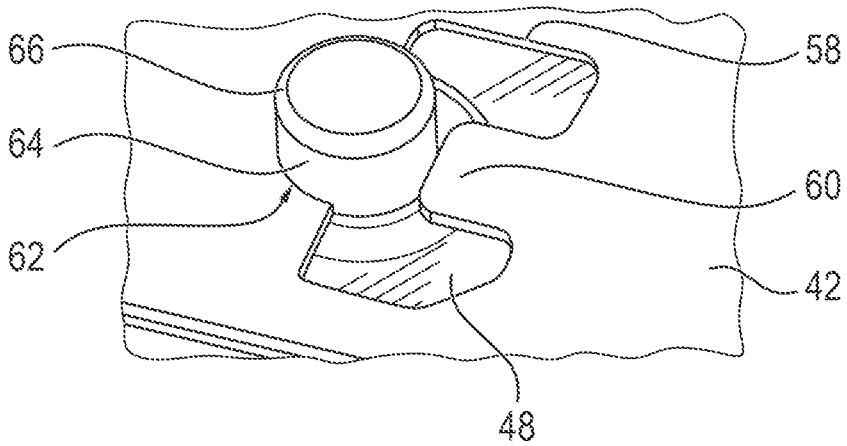
FIG. 10 shows, in a perspective representation, a detail of a recess of the valve plate with a centering projection of the stop plate clamped therein.
Figure 11:
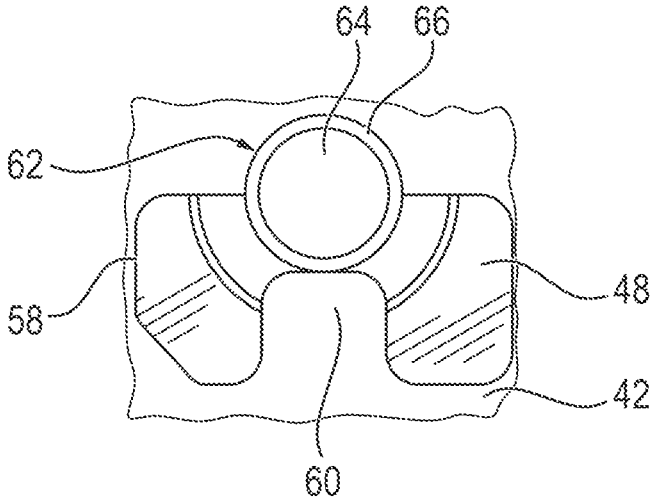
FIG. 11 shows, in a plan view, a detail of the recess of the valve plate with the centering projection of the stop plate clamped therein.

The stop plate 46 and the valve plate 40 are—as is apparent, for example, in FIGS. 6, 8 and 9—in the form of a common, preassembled component. In other words, a preassembled valve assembly 36 is used for assembling the refrigerant compressor 2.

The valve assembly 36 is mechanically fastened in a threaded receiver 53 on the end face of the scroll part 24 by means of only one fastening screw 52. The stop plate 46 and the valve plate 40 thereby each have a feed-through opening 54 in the region of their respective fastening portion 42, 48, which feed-through openings are arranged in alignment one above the other in the preassembled state, so that at least a shaft of the fastening screw 52 can be fed through.

As will be explained hereinbelow with reference to FIGS. 8 to 11, the valve plate 40 is fastened to the stop plate 46 by positive-locking and/or frictional engagement. In other words, the valve plate 40 and the stop plate 46 are joined together by positive-locking and/or frictional engagement for the preassembly of the valve assembly 36.

In addition to the through-opening 54, the valve plate 40 has two further recesses 56, 58 in the region of the fastening portion 42. The recess 56 is in the form of an approximately circular hole. The recess 58, which is spaced apart therefrom, has as is apparent, for example, in FIGS. 10 and 11 an approximately C-shaped cross-sectional shape. As a result of the C-shape of the recess 58, a flexurally elastic clamping lug 60 is isolated in the material of the fastening portion 42 of the valve plate 40. At the edge of the recess 58, opposite the free end of the clamping lug 60, an approximately semi-circular arcuate region 62 is isolated.

The fastening portion 48 of the stop plate 46 has two axially protruding centering projections 64 on the surface facing the valve plate 40. The centering projections 64 are pin-shaped or bolt-shaped or cylindrical and are provided at their respective free ends with an insertion bevel 66.

The centering projections 64 are introduced into the recesses 56 and 58 of the valve plate 40 in the course of the preassembly of the valve assembly 36. The centering projection 64 of the recess 56 thereby acts as a centering or positioning aid during assembly, wherein the centering projection 64 of the recess 58 additionally may be configured for fastening the plates 40, 46 by positive-locking and frictional engagement.

On preassembly of the valve assembly 36, the centering projection 64 of the stop plate 46 is inserted into the recess 58 of the valve plate 40, and the clamping lug 60 rests at its free end against the centering projection 64. On insertion of the centering projection 64, the clamping lug 60 is bent at least partly, so that the centering projection 64 is clamped as a result of the restoring forces between the free end of the clamping lug 60 and the edge of the arcuate region 62, which has a shape complementary to that of the outer contour of the centering projection 64. The centering projection 64 is thus clamped in the recess 58 in a radial direction, that is to say transversely to the axial or longitudinal direction of the centering projection 64. The free end of the clamping lug 60 thereby expediently grips the centering projection 64. As a result of the clamping lug 60 gripping the centering projection 64, positive-locking and frictional engagement between the stop plate 46 and the valve plate 40 that is particularly secure in operation and reliable is achieved.

Figure 12:
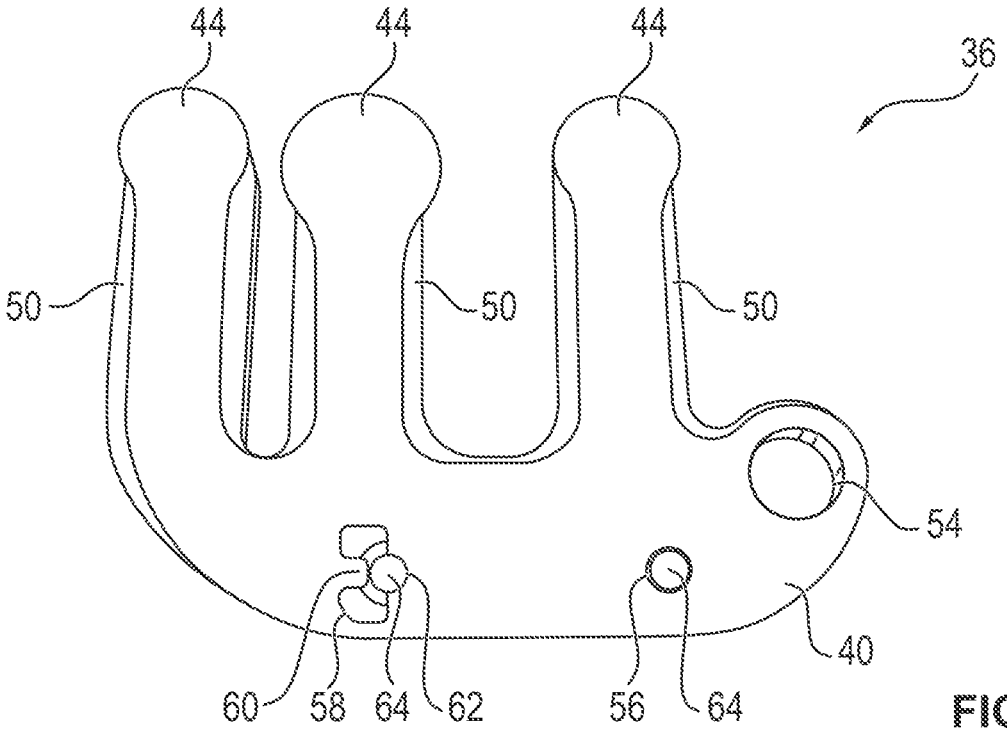
FIG. 12 shows, in a perspective representation, the valve assembly in an alternative embodiment.
Figure 13:
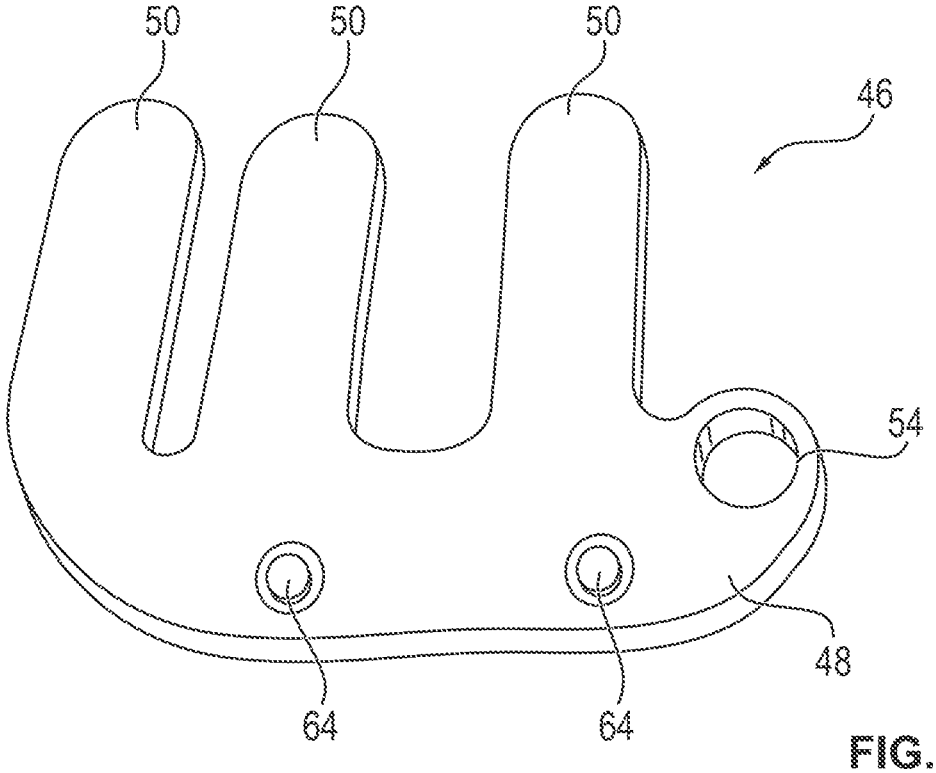
FIG. 13 shows, in a perspective representation, the stop plate in the alternative embodiment.
Figure 14:
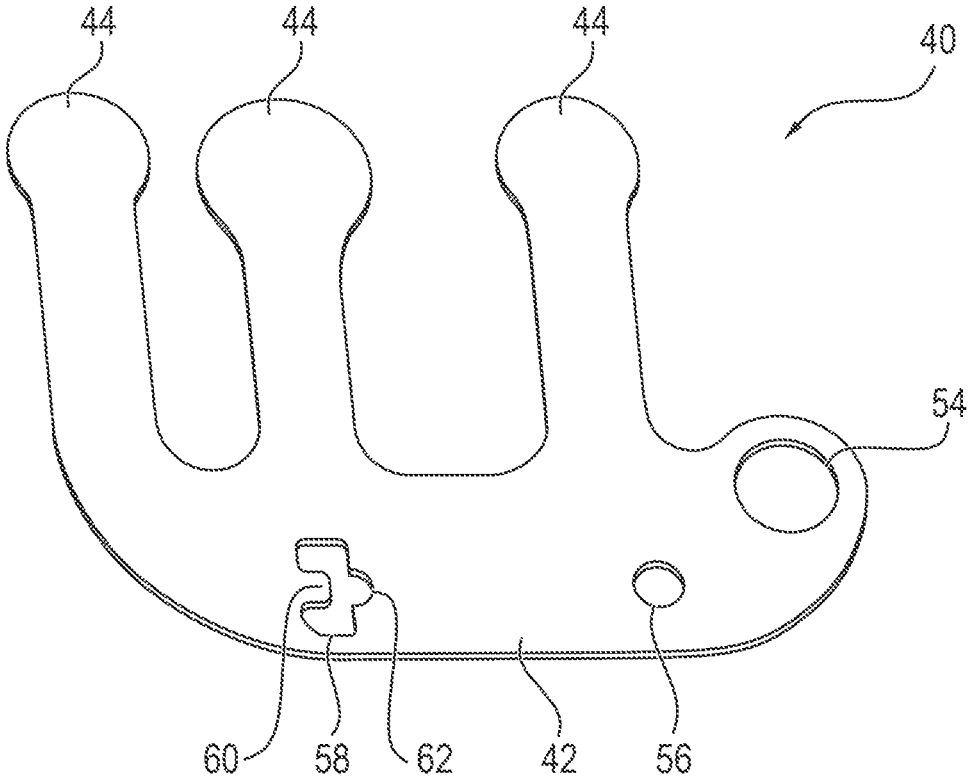
FIG. 14 shows, in a perspective representation, the valve plate in the alternative embodiment.

FIGS. 12 to 14 show an alternative embodiment of the valve assembly 36. This embodiment corresponds to the exemplary embodiment described hereinbefore, and the centering projections 64 are dome-shaped, that is to say hemispherical.

The invention is not limited to the exemplary embodiments described hereinbefore. Rather, other variants of the invention can also be derived therefrom by the person skilled in the art without departing from the subject-matter of the invention. As an example, all the individual features described in connection with the exemplary embodiment can also be combined with one another in a different way without departing from the subject-matter of the invention.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

LIST OF REFERENCE SIGNS

2 refrigerant compressor
4 drive
6 compressor
8 interface
10 end shield
12 drive housing
12*a* housing portion/motor housing
12*b* housing portion/electronics housing
14 motor electronics system
16 housing terminal region
16*a*, 16*b* terminal
18 inlet/inlet opening
20 outlet/outlet opening
22 compressor housing
24 scroll part
26 scroll part
28 inlet opening
30 side wall
32 recess/intermediate region
34 outlet opening
36 valve assembly
38 outlet opening
40 valve plate
42 fastening portion
44 valve finger
46 stop plate
48 fastening portion
50 stop finger
52 fastening screw
54 threaded receiver
56 recess
58 recess
60 clamping lug
62 arcuate region
64 centering projection
66 insertion bevel
A axial direction While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A valve assembly for use in an electrical refrigerant compressor of a motor vehicle, the valve assembly comprising:

a valve plate configured to elastically flex and configured for pressure-regulated opening and closing of an exit opening of the electrical refrigerant compressor, wherein the valve plate includes a flexible elastic clamping lug and at least two recesses; and a rigid stop plate configured to limit movement of the valve plate, wherein the rigid stop plate and the valve plate collectively form a preassembled component, wherein the stop plate includes at least two centering projections axially protruding from and integrally formed to the stop plate, wherein the two centering projections each extend through one of the recesses defined by the valve plate, wherein a first recess includes a substantially C-shaped cross-sectional shape so that the clamping lug is exposed, wherein a second recess is in the form of a circular hole, with a diameter corresponding to the diameter of the centering projection, wherein the first recess includes an edge and a portion of the edge disposed opposite a free end of the clamping lug has a substantially semi-circular arcuate region configured to receive a portion of an outer contour of the centering projection, wherein a distance between the free end of the clamping lug and the semi-circular arcuate region is smaller than the diameter of the centering projection, wherein the clamping lug is at least partially bent in a pre-assembled state so that the centering projecting is clamped between the free end of the clamping lug and the semi-circular arcuate region of the edge of the first recess, and wherein the clamping lug is configured to elastically flex and positively lock and/or frictionally engage the centering projection.

2. The valve assembly of claim 1, wherein the valve plate is fastened to the stop plate by positive-locking and/or frictional engagement.

3. The valve assembly of claim 1, wherein the centering projection is dome-shaped or bolt-shaped.

4. The valve assembly of claim 1, wherein the stop plate includes a fastening portion configured to be fastened the refrigerant compressor and a stop finger extending from and inclined with respect to the fastening portion, and wherein the valve plate includes a fastening portion configured to be fastened to the fastening portion of the stop plate, and a valve finger configured to elastically flex.

5. An electrical refrigerant compressor for use in a motor vehicle, the electrical refrigerant compressor comprising:

an electromotive drive; and a compressor defining an inlet opening and an outlet opening; and the valve assembly of claim 1.

6. The electrical refrigerant compressor of claim 5, wherein the compressor is a scroll compressor including a fixed scroll part and an eccentrically driven movable scroll part.

7. A valve assembly for use in a vehicle electric refrigerant compressor, the valve assembly comprising:

a valve plate having a first rigidity and including, a first fastening portion defining a first aperture and a second aperture, and a clamping lug, wherein the second aperture includes a semi-circular arcuate notch disposed substantially opposite to the clamping lug, and a number of valve fingers extending from the first fastening portion and configured to flex to selectively open and close a number of exit openings defined by the electric refrigerant compressor; and a stop plate having a second rigidity, greater than the first rigidity, and including, a second fastening portion, a number of stop fingers extending from the second fastening portion, a first projection and a second projection each extending from the second fastening portion in an axial direction, wherein the first projection extends into the first aperture and the second projection extends into the second aperture, with the second aperture having a diameter corresponding to the diameter of the second projection, wherein a distance between a free end of the clamping lug and the semi-circular arcuate notch is smaller than the diameter of the second projection, and wherein the clamping lug is configured to elastically flex and is at least partially bent so that a distal end of the clamping lug engages the second projection and the second projection is clamped between the distal end of the clamping lug and an inner periphery of the semi-circular arcuate notch.

8. The valve assembly of claim 7, wherein the number of stop fingers are inclined with respect to the second fastening portion.

9. The valve assembly of claim 7, wherein the first projection is tapered from the second fastening portion.

10. The valve assembly of claim 7, wherein the number of valve fingers are configured to flex with respect to the first fastening portion.

11. The valve assembly of claim 7, wherein the first fastening portion defines a third aperture and the second fastening portion defines a fourth aperture, wherein the third aperture and the fourth aperture are each configured to receive a fastener.

12. The valve assembly of claim 7, wherein the first aperture includes a first portion and a second portion, wherein a tab is disposed between the first portion and the second portion.

13. An electric refrigerant compressor for use in a motor vehicle, the electric refrigerant compressor comprising:

an electric drive;

a compressor fixed to the drive and defining a number of exit openings;

a valve plate having a first rigidity and including, a first fastening portion defining a first aperture and a second aperture, and a clamping lug wherein the second aperture includes a semi-circular arcuate notch disposed substantially opposite to the clamping lug and a number of valve fingers extending from the first fastening portion and configured to flex to selectively open and close the number of exit openings; and a stop plate having a second rigidity, greater than the first rigidity, and including, a second fastening portion, a number of stop fingers extending from the second fastening portion, a first projection and a second projection each extending from the second fastening portion in an axial direction, wherein the first projection extends into the first aperture and the second projection extends into the second aperture, with the second aperture having a diameter corresponding to the diameter of the second projection, wherein a distance between a free end of the clamping lug and the semi-circular arcuate notch is smaller than the diameter of the second projection, and wherein the clamping lug is configured to elastically flex and is at least partially bent so that a distal end of the clamping lug engages the second projection and the second projection is clamped between the distal end of the clamping lug and an inner periphery of the semi-circular arcuate notch.

14. The electric refrigerant compressor of claim 13, wherein the number of stop fingers are inclined with respect to the second fastening portion.

15. The electric refrigerant compressor of claim 13, wherein the first projection is tapered from the second fastening portion.

16. The electric refrigerant compressor of claim 13, wherein the number of valve fingers are configured to flex with respect to the first fastening portion.

17. The electric refrigerant compressor of claim 13, wherein the first fastening portion defines a third aperture and the second fastening portion defines a fourth aperture, wherein the third aperture and the fourth aperture are each configured to receive a fastener.

18. The electric refrigerant compressor of claim 13, wherein the first aperture includes a first portion and a second portion, wherein a tab is disposed between the first portion and the second portion.

* * * * *